US006213725B1

(12) United States Patent
Chou

(10) Patent No.: US 6,213,725 B1
(45) Date of Patent: Apr. 10, 2001

(54) COMPRESSOR HAVING AN IMPROVED PISTON

(76) Inventor: Wen San Chou, No. 15, Lane 833, Wen Hsien Road, Tainan (TW), 704

( * ) Notice: Subject to any disclaimer, the term of this patent is extended or adjusted under 35 U.S.C. 154(b) by 0 days.

(21) Appl. No.: 09/460,290

(22) Filed: Dec. 11, 1999

Related U.S. Application Data

(63) Continuation-in-part of application No. 09/049,904, filed on Mar. 30, 1998.

(51) Int. Cl.[7] ..... F04F 11/00
(52) U.S. Cl. ..... 417/63; 417/415; 417/526
(58) Field of Search ..... 417/63, 38, 512, 417/43, 526, 44.6, 366, 415, 231, 467; 91/422, 43; 92/256; 123/45 A, 316; 22/1, 78, 341

(56) References Cited

U.S. PATENT DOCUMENTS 1,470,548 * 10/1923 Spohrer ..... 417/415
4,023,467 * 5/1977 Thurner ..... 91/422
5,215,447 * 6/1993 Wen ..... 417/415
5,655,887 * 8/1997 Chou ..... 417/63
5,681,154 * 10/1997 Yang ..... 417/512
6,065,947 * 5/2000 Wu ..... 417/526

* cited by examiner

*Primary Examiner*—Teresa Walberg
*Assistant Examiner*—Quang Van

(57) ABSTRACT

A compressor includes a housing having an upward extending tube coupled to a pressure gage. A piston is slidably received in the housing and has an annular groove for loosely receiving a sealing ring and has one or more notches communicating with the annular groove of the piston. A gear is driven by a motor and coupled to the piston with an eccentric pin for moving the piston along the housing in a reciprocating action. The gear has one half of greater teeth than that of the other half for increasing the driving effect of the compressor.

1 Claim, 6 Drawing Sheets

COMPRESSOR HAVING AN IMPROVED PISTON

The present invention is a continuation-in-part of U.S. patent application Ser. No. 09/049,904, filed on Mar. 30, 1998, allowed.

BACKGROUND OF THE INVENTION

1. Field of the Invention

The present invention relates to a compressor, and more particularly to a compressor having an improved piston.

2. Description of the Prior Art

Typical compressors comprise a piston slidably received in a piston housing and a sealing ring solidly engaged on the piston and engaged between the piston and the piston housing, such that the typical piston or the sealing ring may be easily damaged. In addition, a number of valve members are required for controlling the air into and out of the piston housing.

The present invention has arisen to mitigate and/or obviate the afore-described disadvantages of the conventional compressors.

SUMMARY OF THE INVENTION

The primary objective of the present invention is to provide a compressor includes a piston having a sealing ring loosely engaged thereon for preventing the sealing ring from solidly engaging with the piston housing and for preventing the piston from being easily damaged.

In accordance with one aspect of the invention, there is provided a compressor comprising a housing including a tube extended upward therefrom, and including a passage communicating the housing with the tube, the housing including a chamber formed therein, the tube including a pipe extended outward therefrom, a pressure gage connected to the pipe, a check valve including a valve member and a spring received in the tube for controlling an air flow passage from the housing to the pipe, a piston slidably received in the chamber of the housing, the piston including an outer peripheral portion having an annular groove formed therein, and including an upper portion having at least one notch formed therein and communicating with the annular groove of the piston, the piston including a rod extended downward therefrom, the annular groove of the piston including an upper portion having a size greater than a lower portion of the annular groove of the piston, a sealing ring loosely received in the annular groove of the piston and movable between the upper portion and the lower portion of the annular groove of the piston, the notch of the piston being communicating with the annular groove of the piston and being communicating with the chamber of the housing when the sealing ring is engaged in the upper portion of the annular groove of the piston, a base secured to the housing, and means for forcing the piston to move along the chamber of the housing in a reciprocating action, the forcing means including a motor secured to the base and having a pinion provided thereon, a gear rotatably secured to the base at a pivot shaft and engaged with the pinion and driven by the motor via the pinion, the gear including a first half having a plurality of first teeth and including a second half having a plurality of second teeth, the first teeth including a size greater than that of the second teeth, the gear including a casing provided thereon, and a block received in the casing and secured to the pivot shaft and rotated in concert with the gear, the block including a pin eccentric relative to the pivot shaft and coupled to the rod for coupling the piston to the block and the gear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
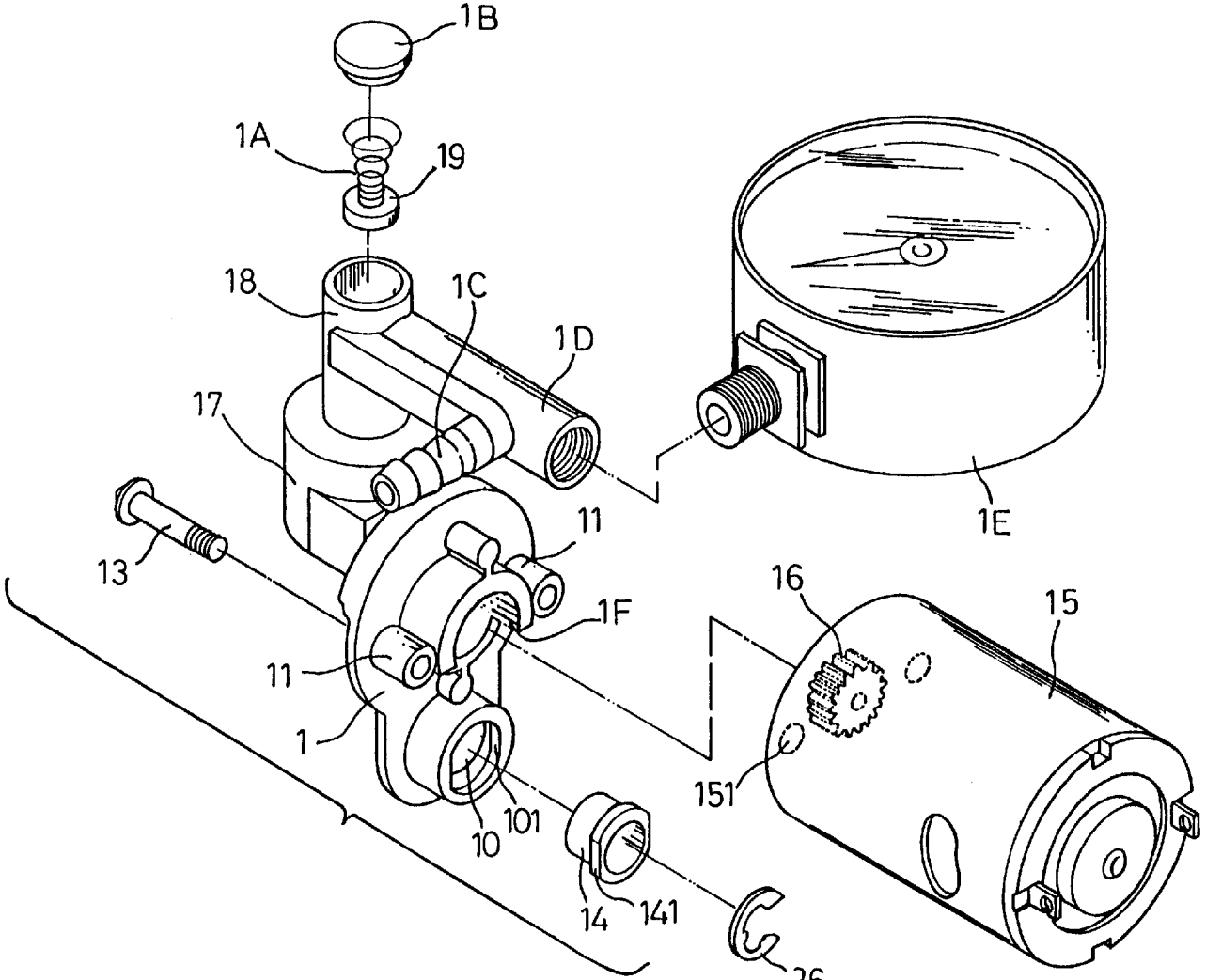
FIGS. 1 and 2 are partial exploded views of a compressor in accordance with the present invention.
Figure 2:
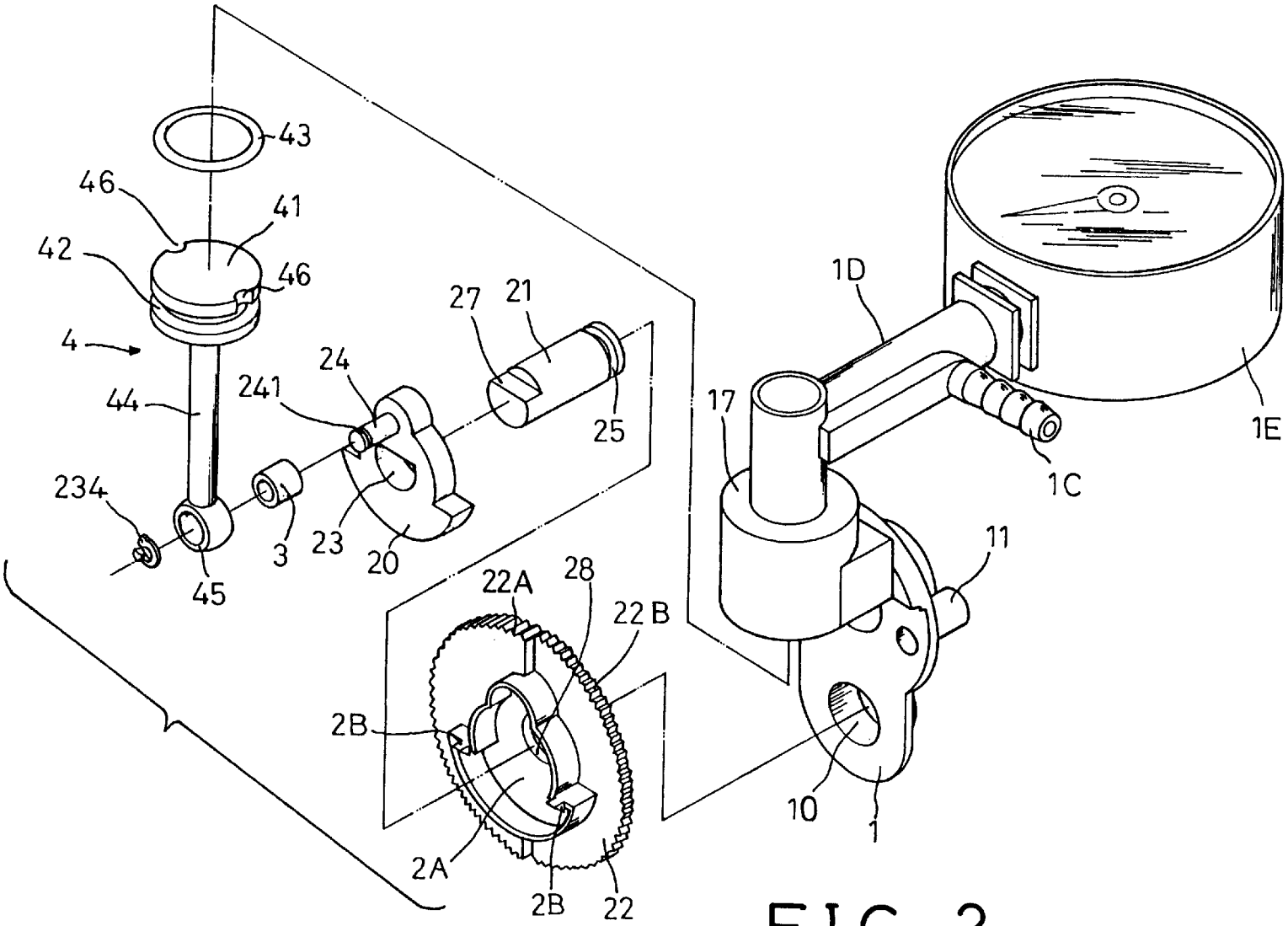
Figure 3:
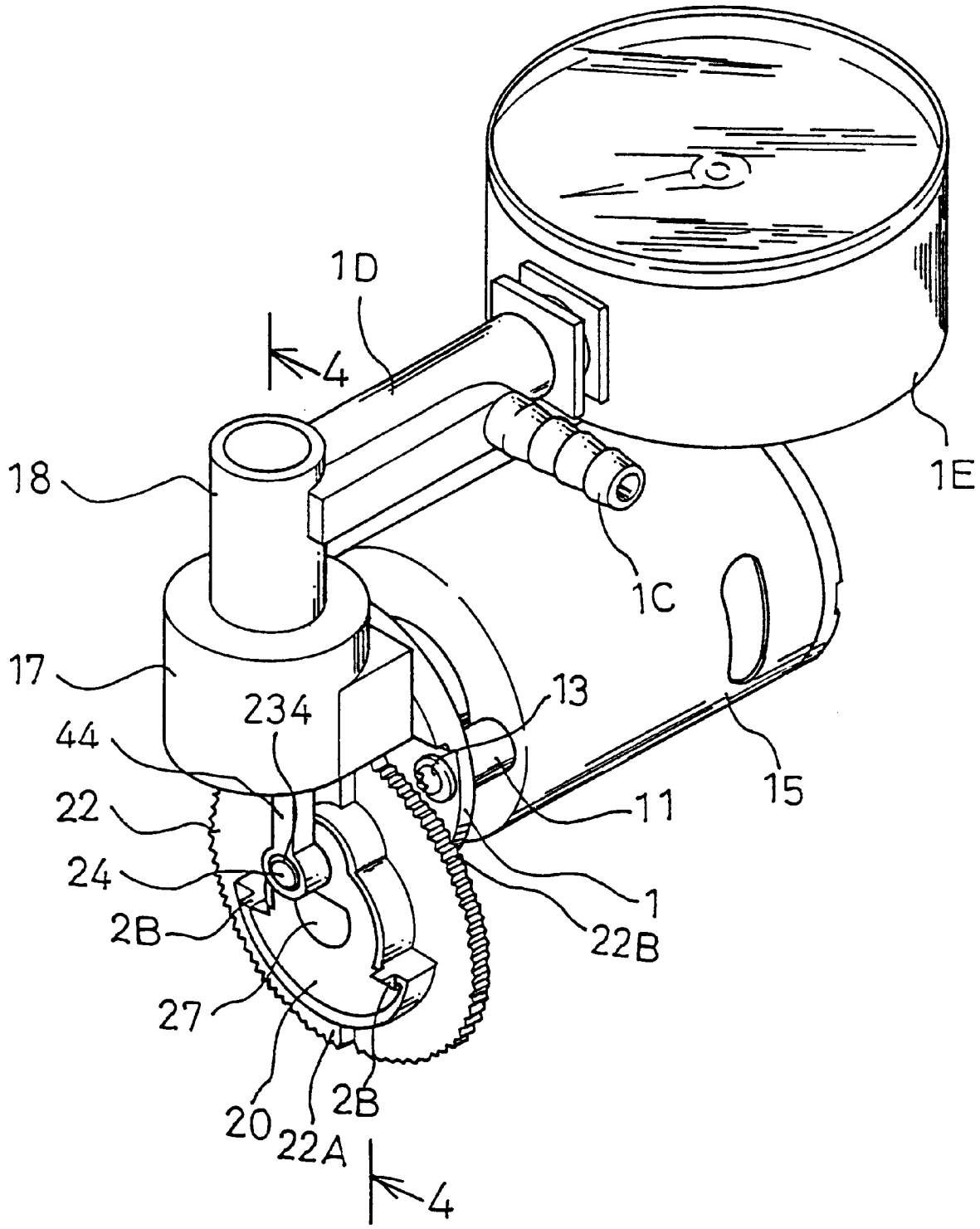
FIG. 3 is a perspective view of the compressor.
Figure 4:
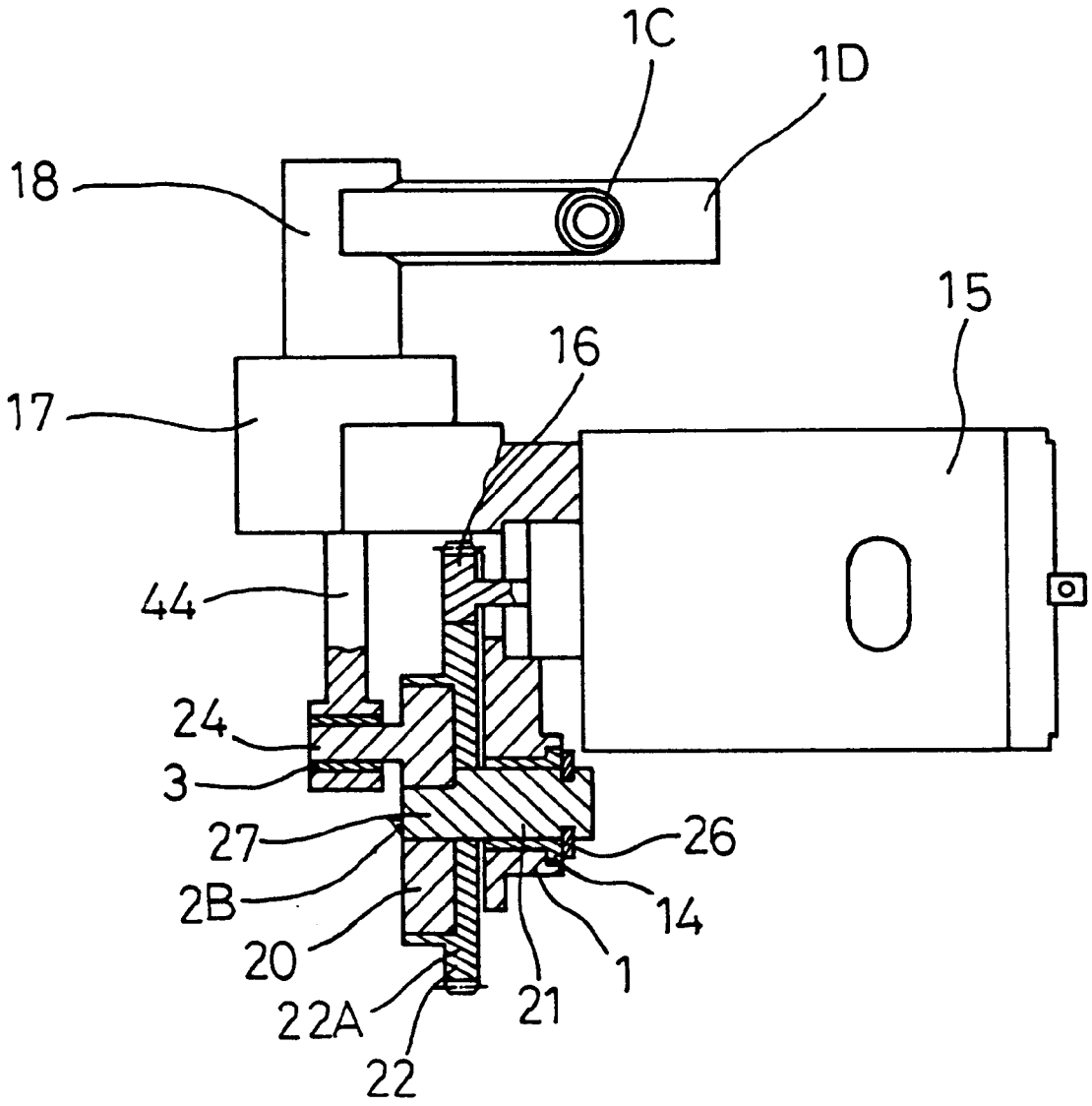
FIG. 4 is a partial cross sectional view taken along lines 4—4 of FIG. 3.

Referring to the drawings, and initially to FIGS. 1–4, a compressor in accordance with the present invention comprises a base 1 including an opening 1F formed therein for receiving a pinion 16 of a motor 15. The motor 15 includes two screw holes 151 formed therein and aligned with two hubs 11 of the base 1 for receiving fasteners 13 which may secured the motor 15 to the base 1. The base 1 includes an aperture 10 formed therein for receiving a pivot shaft 21 which has one end secured to the base 1 by a clamping ring 26 and which has the other end 27 extended outward of the base 1. A bushing 14 is engaged in the aperture 10 of the base 1 and is engaged between the pivot shaft 21 and the base 1 and includes one or more flat surfaces 141 engaged with the corresponding flat surfaces 101 of the base 10 for preventing the bushing 14 from rotating relative to the base 1. A housing 17 is secured to the base 1 and includes a tube 18 extended upward therefrom, and a pipe 1D extended from the tube 18 and coupled to a nozzle or a hose via a coupler 1C for output the pressurized air generated by the compressor. An air gage or a pressure gage 1E is coupled to the pipe 1D for measuring the air pressure in the housing 17. The tube 18 includes a valve member 19 and a spring 1A received therein and retained in the tube 18 with a cap 1B for forming a check valve and for allowing the pressurized air to flow from the housing 17 to the coupler 1C only and for preventing the pressurized air to flow back into the housing 17.

A gear 22 includes a hole 28 formed therein for receiving the pivot shaft 21 and for rotatably securing to the base 1 at the pivot shaft 21 and includes a casing 2A provided therein for receiving and supporting a block 20. The block 20 includes a non-circular hole 23 formed therein for receiving and engaging onto a non-circular end 27 of the pivot shaft 21 such that the block 20 rotates in concert with the pivot shaft 21. The block 20 includes a pin 24 spaced from the pivot shaft 21 or eccentric relative to the pivot shaft 21. The pin 24 may also be directly extended from the gear 22, instead of from the block 20. The casing 2A includes one or more shoulders each having a stop 2B extended therefrom for engaging with and for retaining the block 20 of different thicknesses in the casing 2A. The gear 22 includes one half having a number of teeth 22A of a greater thickness than the teeth 22B of the other half of the gear 22. The teeth 22A, 22B of the gear 22 are engaged with the pinion 16 of the motor 15. The engaging area between the pinion 16 and the teeth 22A is greater than that between the other teeth 22B and the pinion 16 such that the motor 15 may drive the gear 22 with a less power when the pinion 16 is engaged with the teeth 22B and such that the motor 15 may effectively drive and rotate the gear 22.

The housing 17 includes a chamber 171 (FIGS. 5–8) formed therein for slidably receiving a piston 4 which includes an annular groove 42 formed in the outer peripheral portion for receiving a sealing ring 43. The housing 17 includes a passage 172 formed therein for communicating the chamber 171 of the housing 17 with the tube 18. The sealing ring 43 may make an air tight seal between the piston 4 and the housing 17. The piston 4 includes a rod 44 extended downward therefrom and having a ring 45 rotatably secured to the pin 24 with a bearing or a bushing 3 and secured to the pin 24 by a clamping ring 234, such that the piston 4 may be moved along the housing 17 in a reciprocating action by the motor 15 via the eccentric pin 24 of the gear 22. The piston 4 includes an upper surface 41 and includes one or more notches 46 formed in the upper portion thereof and communicating the annular groove 42 of the piston 4 (FIGS. 2, 5–8) with the chamber (171) of the housing (17). The annular groove 42 of the piston 4 includes a upper portion having a size greater than the lower portion of the piston 4 for loosely receiving the sealing ring 43.

Figure 6:
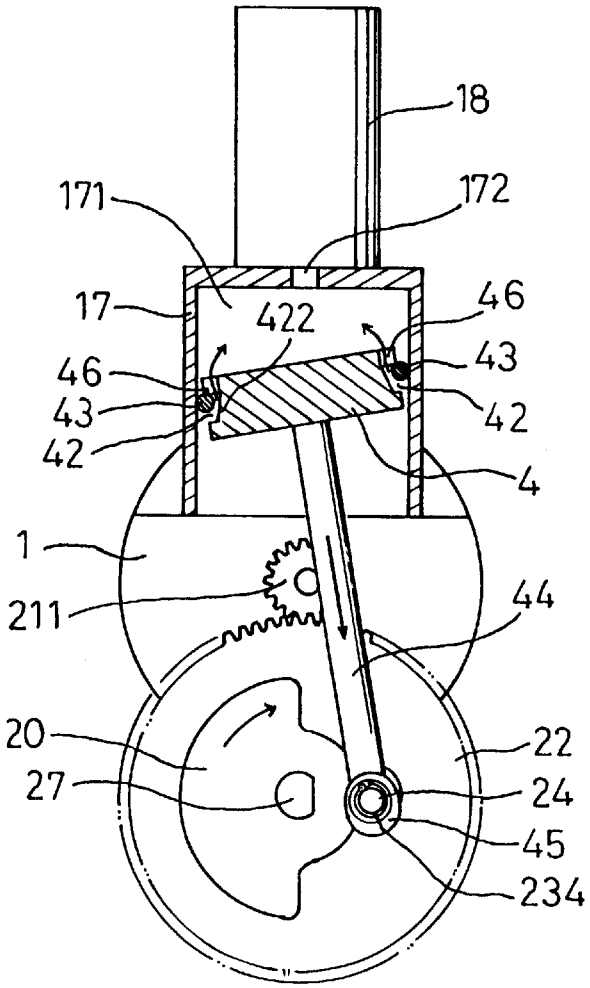
FIGS. 5, 6, 7, 8 are partial cross sectional views illustrating the operation of the compressor.
Figure 5:
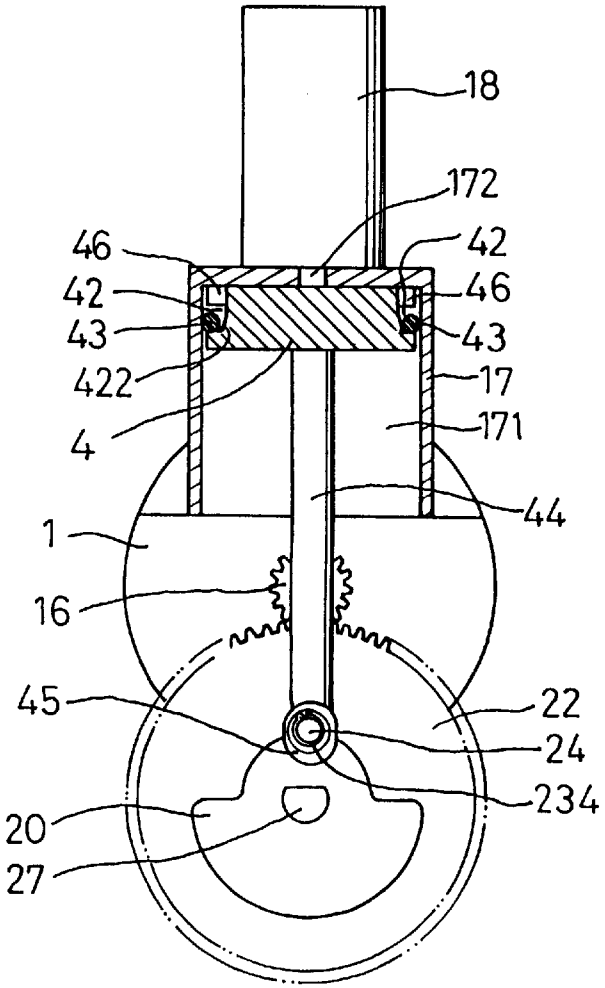
Figure 8:
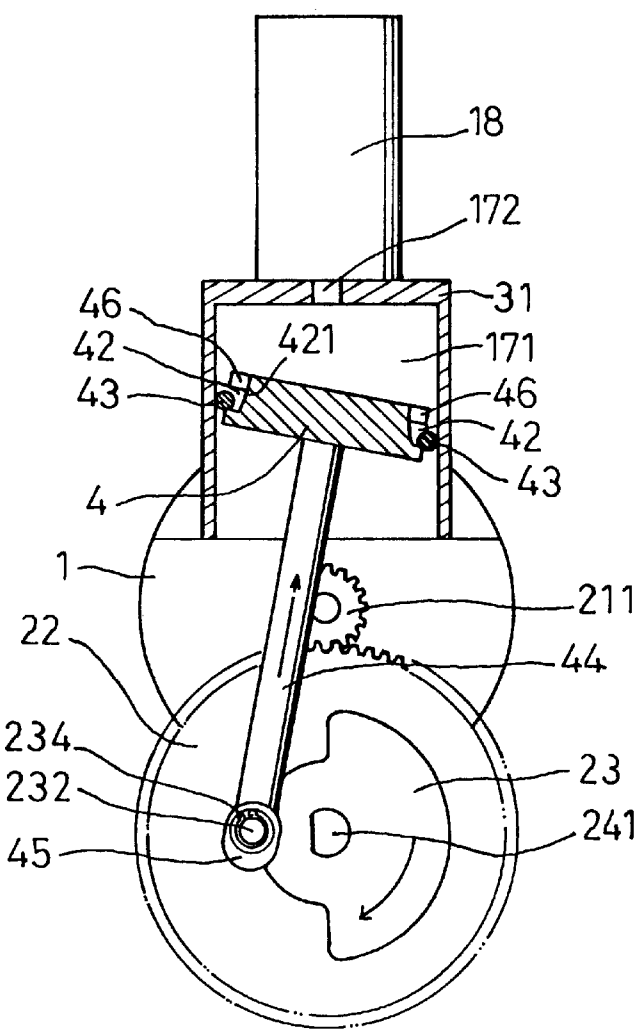
Figure 7:
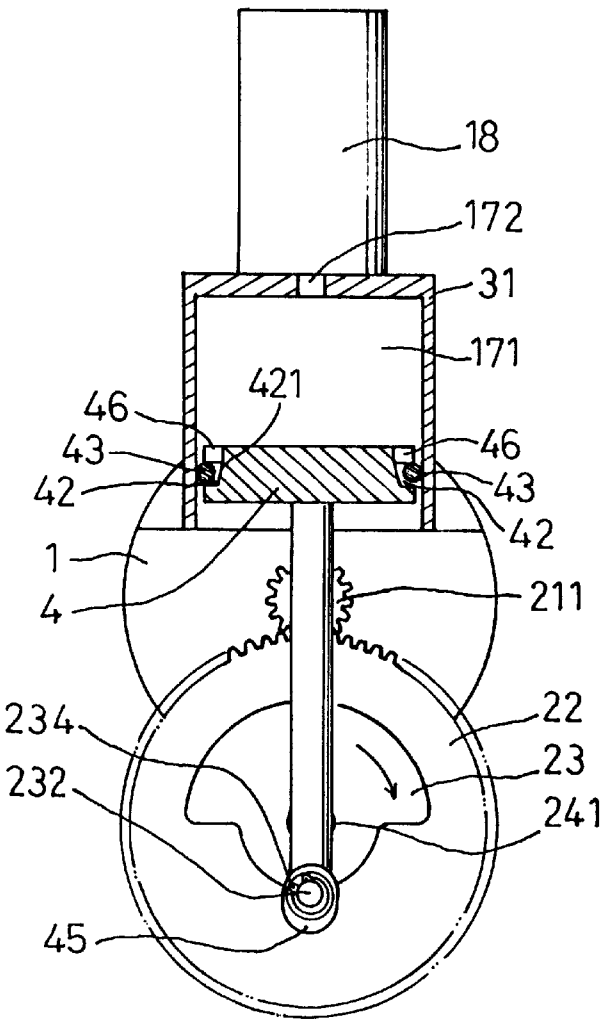

In operation, as shown in FIGS. 5–8, the piston 4 may be moved up and down along the housing 17 in a reciprocating action by the motor 15 via the eccentric pin 24 of the block 20 and the gear 22. When the piston 4 is moved from the position in FIG. 7 toward the tube 18 in the position as shown in FIG. 5 via the intermediate position as shown in FIG. 8, the sealing ring 43 is forced toward the lower portion of the piston 4 to engage with the piston 4 such that the air may be forced into the tube 18 through the passage 172 (FIG. 5). When the piston 4 moves downward from the top position as shown in FIG. 5 to the lower position as shown in FIG. 7 via an intermediate position as shown in FIG. 6, the air may flow into the chamber 171 of the housing 17 via the annular groove 42 of the piston 4 and the notches 46 of the piston 4. The air may then be forced into the tube 18 again when the piston 4 is forced toward the tube 18 again. The air may thus be effectively forced through the tube 18 without the other valve members.

Accordingly, the compressor includes a piston having a loosely received sealing ring for preventing the piston from being easily damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A compressor comprising:

a) a housing including a tube extended upward therefrom, and including a passage formed therein and communicating said housing with said tube, said housing including a chamber formed therein, said tube including a pipe extended outward therefrom, b) a pressure gage connected to said pipe, c) a check valve including a valve member and a spring received in said tube for controlling an air flow passage from said housing to said pipe, d) a piston slidably received in said chamber of said housing, said piston including an outer peripheral portion having an annular groove formed therein, and including an upper portion having at least one notch formed therein and communicating with said annular groove of said piston, said piston including a rod extended downward therefrom, said annular groove of said piston including an upper portion having a size greater than a lower portion of said annular groove of said piston, e) a sealing ring loosely received in said annular groove of said piston and movable between said upper portion and said lower portion of said annular groove of said piston, said at least one notch of said piston being communicating with said annular groove of said piston and being communicating with said chamber of said housing when said sealing ring is engaged in said upper portion of said annular groove of said piston, f) a base secured to said housing, and g) means for forcing said piston to move along said chamber of said housing in a reciprocating action, said forcing means including:

i) a motor secured to said base and having a pinion provided thereon, ii) a gear rotatably secured to said base at a pivot shaft and engaged with said pinion and driven by said motor via said pinion, said gear including a first half having a plurality of first teeth and including a second half having a plurality of second teeth, said first teeth including a size greater than that of said second teeth, said gear including a casing provided thereon, and iii) a block received in said casing and secured to said pivot shaft and rotated in concert with said gear, said block including a pin extended therefrom and eccentric relative to said pivot shaft, said pin being coupled to said rod for coupling said piston to said block and said gear.

* * * * *